US009530293B2

(12) United States Patent
Zhevelev

(10) Patent No.: US 9,530,293 B2
(45) Date of Patent: Dec. 27, 2016

(54) WIRELESS ACOUSTIC GLASS BREAKAGE DETECTORS

(71) Applicant: Tyco Fire & Security GmbH, Neuhausen am Rheinfall (CH)

(72) Inventor: Boris Zhevelev, Rishon le Zion (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 14/645,525

(22) Filed: Mar. 12, 2015

(65) Prior Publication Data

US 2016/0093178 A1 Mar. 31, 2016

Related U.S. Application Data

(60) Provisional application No. 62/057,316, filed on Sep. 30, 2014.

(51) Int. Cl.

| | |
|---|---|
| ***G08B 13/00*** | (2006.01) |
| ***G08B 21/00*** | (2006.01) |
| ***G08B 13/04*** | (2006.01) |
| ***G08B 21/18*** | (2006.01) |
| ***G08B 29/00*** | (2006.01) |
| ***G08B 29/22*** | (2006.01) |

(52) U.S. Cl.

CPC ..... *G08B 13/04* (2013.01); *G08B 21/18* (2013.01); *G08B 29/00* (2013.01); *G08B 29/22* (2013.01)

(58) Field of Classification Search

CPC ..... G08B 21/18; G08B 13/04; G08B 29/14; H04R 19/04; H04R 2499/11; H04R 2499/15

USPC .... 340/540, 550, 566, 541, 508; 367/13, 93; 381/82, 92

See application file for complete search history.

(56) References Cited

U.S. PATENT DOCUMENTS

| | | | | |
|---|---|---|---|---|
| 4,668,941 | A | 5/1987 | Davenport et al. | |
| 4,845,464 | A * | 7/1989 | Drori | B60R 25/1004 307/10.2 |
| 5,192,931 | A * | 3/1993 | Smith | G08B 13/04 340/541 |
| 5,323,141 | A | 6/1994 | Petek | |

(Continued)

OTHER PUBLICATIONS

International Search Report and Written Opinion both dated Oct. 8, 2015, from Applicant's related case PCT/IL2015/050668.

*Primary Examiner* — Hoi Lau

(74) *Attorney, Agent, or Firm* — HoustonHogle LLP

(57) ABSTRACT

An acoustic glass breakage detector including a pulsating current-powered microphone and operable for generating pulsed signal data corresponding to sound waves detected thereby, a sample and hold circuit operable for converting the pulsed signal data into a voltage level signal and storing the voltage level signal, a sound frequency band pass amplifier operable for ascertaining whether the voltage level signal corresponds to an explosion-like sound typical of an initial glass-breakage sound, a flex wave band pass amplifier operable for ascertaining whether the voltage level signal corresponds to a flex wave typical of an initial glass-breakage sound, and circuitry operable, responsive to ascertaining that the voltage level signal corresponds to an explosion-like sound typical of an initial glass-breakage event and that the voltage level signal corresponds to a flex wave typical of an initial glass-breakage sound, for ascertaining that the pulsed signal data is indicative of a glass-breakage event.

17 Claims, 2 Drawing Sheets

(56) References Cited

U.S. PATENT DOCUMENTS

| | | | | | |
|---|---|---|---|---|---|
| 5,414,409 | A | | 5/1995 | Voosen et al. | |
| 5,471,195 | A | * | 11/1995 | Rickman | G08B 13/04 340/546 |
| 5,510,767 | A | * | 4/1996 | Smith | G08B 13/04 340/550 |
| 5,515,029 | A | * | 5/1996 | Zhevelev | G08B 13/04 340/540 |
| 5,524,099 | A | * | 6/1996 | Rickman | G08B 29/14 340/508 |
| 5,742,232 | A | * | 4/1998 | Kurahashi | G08B 13/04 340/541 |
| 5,796,336 | A | * | 8/1998 | Ishino | G08B 13/04 340/544 |
| 5,917,410 | A | | 6/1999 | Cecic et al. | |
| 6,041,020 | A | * | 3/2000 | Caron | G01H 9/008 356/340 |
| 6,538,570 | B1 | * | 3/2003 | Smith | G08B 13/04 340/550 |
| 9,349,269 | B2 | * | 5/2016 | Zhevelev | G08B 21/18 |
| 2015/0194036 | A1 | * | 7/2015 | Zhevelev | G08B 21/18 340/540 |
| 2016/0093178 | A1 | * | 3/2016 | Zhevelev | G08B 13/04 340/550 |

* cited by examiner

WIRELESS ACOUSTIC GLASS BREAKAGE DETECTORS

REFERENCE TO RELATED APPLICATIONS

Reference is made to U.S. Provisional Patent Application Ser. No. 62/057,316, filed Sep. 30, 2014 and entitled "WIRELESS ACOUSTIC GLASS BREAKING DETECTORS", the disclosure of which is hereby incorporated by reference and priority of which is hereby claimed pursuant to 37 CFR 1.78(a) (4) and (5)(i).

FIELD OF THE INVENTION

The present invention relates to wireless acoustic glass breakage detectors in general and, in particular, to wireless power-efficient battery-powered acoustic glass breakage detectors which employ a pulsed microphone power supply.

BACKGROUND OF THE INVENTION

Monitoring for glass breakage over long periods of time by a wireless battery-powered detector requires that the detector be extremely power-efficient. Preferably, providing for such power efficiency includes, for example, ignoring irrelevant acoustic events which do not warrant triggering of an alarm. Additionally, a power-efficient detector is typically characterized by very low stand-by current consumption. However, a detector having a low stand-by current consumption is typically slow to respond to sudden and unexpected acoustic events.

Currently commercially available wireless glass breakage detectors include, for example, the ShatterPro™ sensor commercially available from UTC Fire & Security of Bradenton Fla. The ShatterPro™ sensor employs micropower electric microphones that do not include an embedded buffer. Due to inherent difficulties in matching the high output impedance of such microphones with currently available amplifiers, these detectors are ineffective in detecting low frequency sounds in the range of 10 Hz-50 Hz, which are the frequencies typically generated by glass breakage.

Other solutions have been proposed, such as those described in U.S. Pat. Nos. 5,192,931, 4,668,941, and 5,323,141. However, these solutions require relatively high power consumption, which renders them unsuitable for use with battery-powered detectors.

SUMMARY OF THE INVENTION

The present invention seeks to provide a wireless power-efficient battery-powered acoustic glass breakage detector.

There is thus provided in accordance with a preferred embodiment of the present invention an acoustic glass breakage detector including a microphone, the microphone being powered by a pulsating microphone current, the microphone being operable for generating pulsed signal data corresponding to sound waves detected thereby and to a pulse of the pulsating microphone current, a sample and hold circuit operable for receiving the pulsed signal data from the microphone, converting the pulsed signal data into a voltage level signal and storing the voltage level signal, a sound frequency band pass amplifier operable for receiving the voltage level signal from the sample and hold circuit and for ascertaining whether the voltage level signal corresponds to an explosion-like sound typical of an initial glass-breakage sound, a flex wave band pass amplifier operable for receiving the voltage level signal from the sample and hold circuit and for ascertaining whether the voltage level signal corresponds to a flex wave typical of an initial glass-breakage sound, and AND circuitry operable, responsive to both ascertaining that the voltage level signal corresponds to an explosion-like sound typical of an initial glass-breakage sound and ascertaining that the voltage level signal corresponds to a flex wave typical of an initial glass-breakage sound, for ascertaining that the pulsed signal data received from the microphone is indicative of a glass-breakage event.

Preferably, the sample and hold circuit is powered by a pulsating sample and hold circuit current. Preferably, the detector also includes a microprocessor operable for synchronously controlling the pulsating microphone current and the pulsating sample and hold circuit current.

Preferably, the AND circuitry is also operable, responsive to ascertaining that the pulsed signal data received from the microphone is indicative of a glass-breakage event, to communicate an indication of the glass-breakage event to the microprocessor. Preferably, the microprocessor is also operable, responsive to receiving the indication of the glass-breakage event, for receiving and analyzing additional signal data from the sample and hold circuit, the additional signal data being generated subsequent to generation of the signal data indicative of the glass-breakage event, and further ascertaining whether the additional signal data is further indicative of the glass-breakage event.

Preferably, the microphone is a wide-band buffered electronic microphone. Preferably, the microphone is operable for detecting sound waves having a frequency between 10 Hz and 16 KHz. Preferably, the microprocessor is operable for synchronously controlling the pulsating microphone current and the pulsating sample and hold circuit current by employing at least one of constant frequency control, variable frequency control and variable duty cycle control.

Preferably, the microphone has an average electric current consumption of 3-5 micro amperes. Preferably, the system is battery-powered.

There is also provided in accordance with another preferred embodiment of the present invention a method for acoustically detecting glass breakage, the method including powering a microphone by a pulsating microphone current, receiving, from the microphone, pulsed signal data generated by the microphone and corresponding to sound waves detected thereby, converting the pulsed signal data into a voltage level storing the voltage level signal, ascertaining whether the voltage level signal corresponds to an explosion-like sound typical of an initial glass-breakage sound, ascertaining whether the voltage level signal corresponds to a flex wave typical of an initial glass-breakage sound, and responsive to both ascertaining that the voltage level signal corresponds to an explosion-like sound typical of an initial glass-breakage sound and ascertaining that the voltage level signal corresponds to a flex wave typical of an initial glass-breakage sound, ascertaining that the pulsed signal data received from the microphone is indicative of a glass-breakage event.

Preferably, the method also includes responsive to receiving the indication of the glass-breakage event, receiving and analyzing additional signal data from the sample and hold circuit, the additional signal data being generated subsequent to generation of the signal data indicative of the glass-breakage event, and further ascertaining whether the additional signal data is further indicative of the glass-breakage event.

Preferably, the microphone is a wide-band buffered electronic microphone. Preferably, the microphone is operable for detecting sound waves having a frequency between 10 Hz and 16 KHz.

Preferably, the pulsating microphone current is generated by employing at least one of constant frequency control, variable frequency control and variable duty cycle control. Preferably, the microphone has an average electric current consumption of 3-5 micro amperes. Preferably, the microphone is battery-powered.

BRIEF DESCRIPTION OF THE DRAWINGS

The present invention will be understood and appreciated more fully from the following detailed description, taken in conjunction with the drawings in which.

DETAILED DESCRIPTION OF A PREFERRED RED EMBODIMENT

The present invention seeks to provide a wireless battery-powered power-efficient acoustic glass breakage detector (GBD) which employs buffered electronic microphones to achieve reliable recognition of glass breakage sounds. Preferably, a wide band microphone having a built-in buffer is powered by periodic short voltage pulses, wherein resulting output signal data is periodically stored in a suitable sample & hold (S&H) circuit. Several control schemes may be employed in controlling the pulsed-powered microphone, such as, for example, constant frequency control, variable frequency control and variable duty cycle control.

The output signal data stored in the S&H circuit is preferably processed only after the microphone detects an initial glass-breakage sound, which is the first sound typically detected in a typical sequence of glass breakage sounds. An initial glass-breakage sound typically includes a coincidence of flex waves and a typical explosion-like sound.

It is a particular feature of the present invention that this method of powering the microphone with periodic short voltage pulses provides for relatively low power consumption by the microphone without compromising the frequency range of detected sounds. Additionally, the microphone is operative to detect sounds in the frequency range of 10 Hz-16 KHz, which includes frequencies typically generated by glass breakage. Suitable microphones which are currently commercially available include, for example, the WM-64PC microphone commercially available from Panasonic Corporation of Osaka, Japan.

A pulsed-powered microphone as described hereinabove typically has an average electric current consumption of 3-5 micro amperes. Additional components of the GBD of the present invention, such as analog amplifiers, frequency band filters, microprocessors and transmitters are preferably implemented as micro-power elements, which typically have an average current consumption of 7-10 micro amperes. Therefore, the GBD of the present invention, when powered by a suitable battery such as, for example, a CR123 battery, is able to operate continuously for 3-5 years without necessitating battery replacement.

Figure 1:
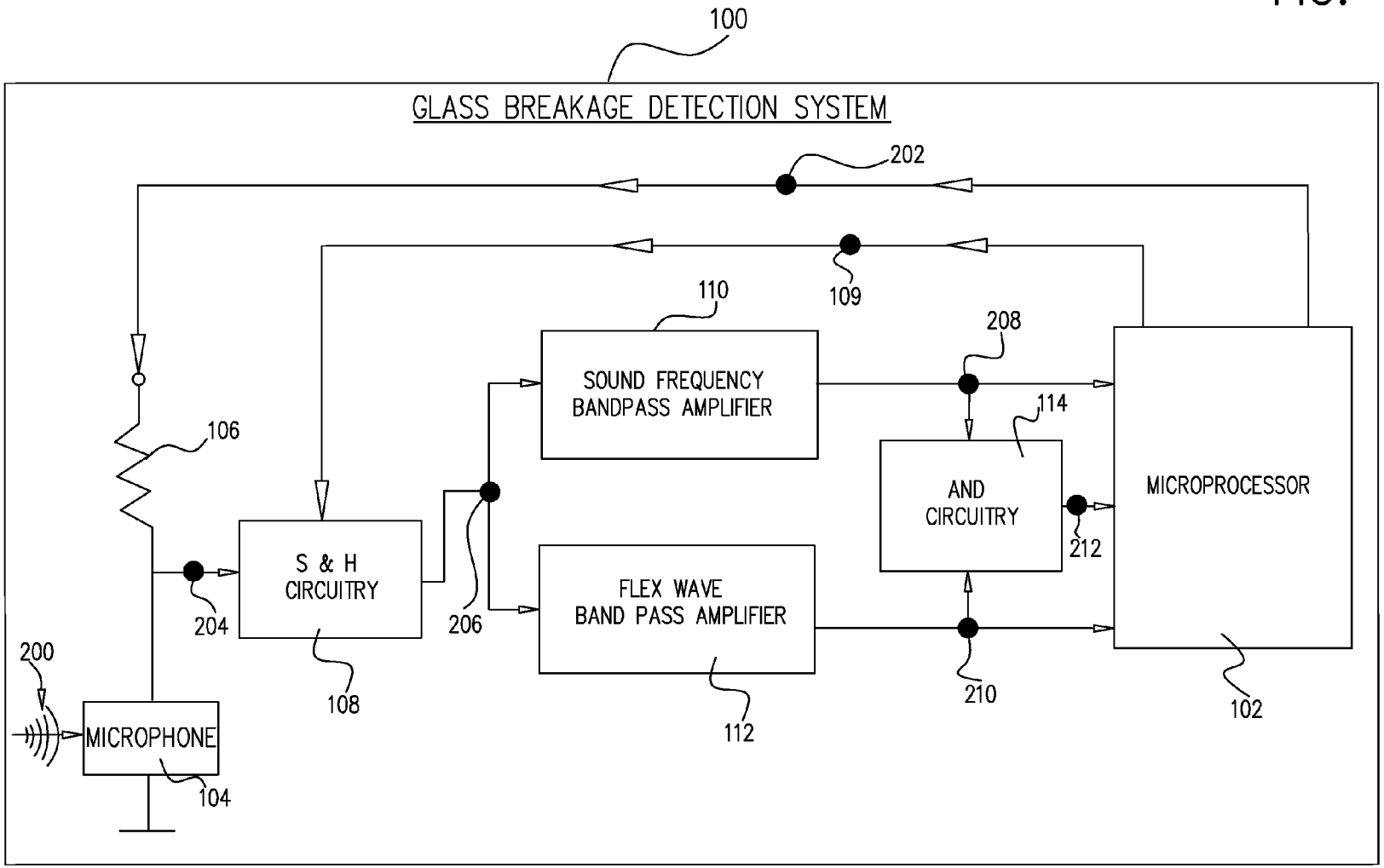
FIG. 1 is a simplified block diagram illustration of a glass breakage detection system constructed and operative in accordance with a preferred embodiment of the present invention.
Figure 2:
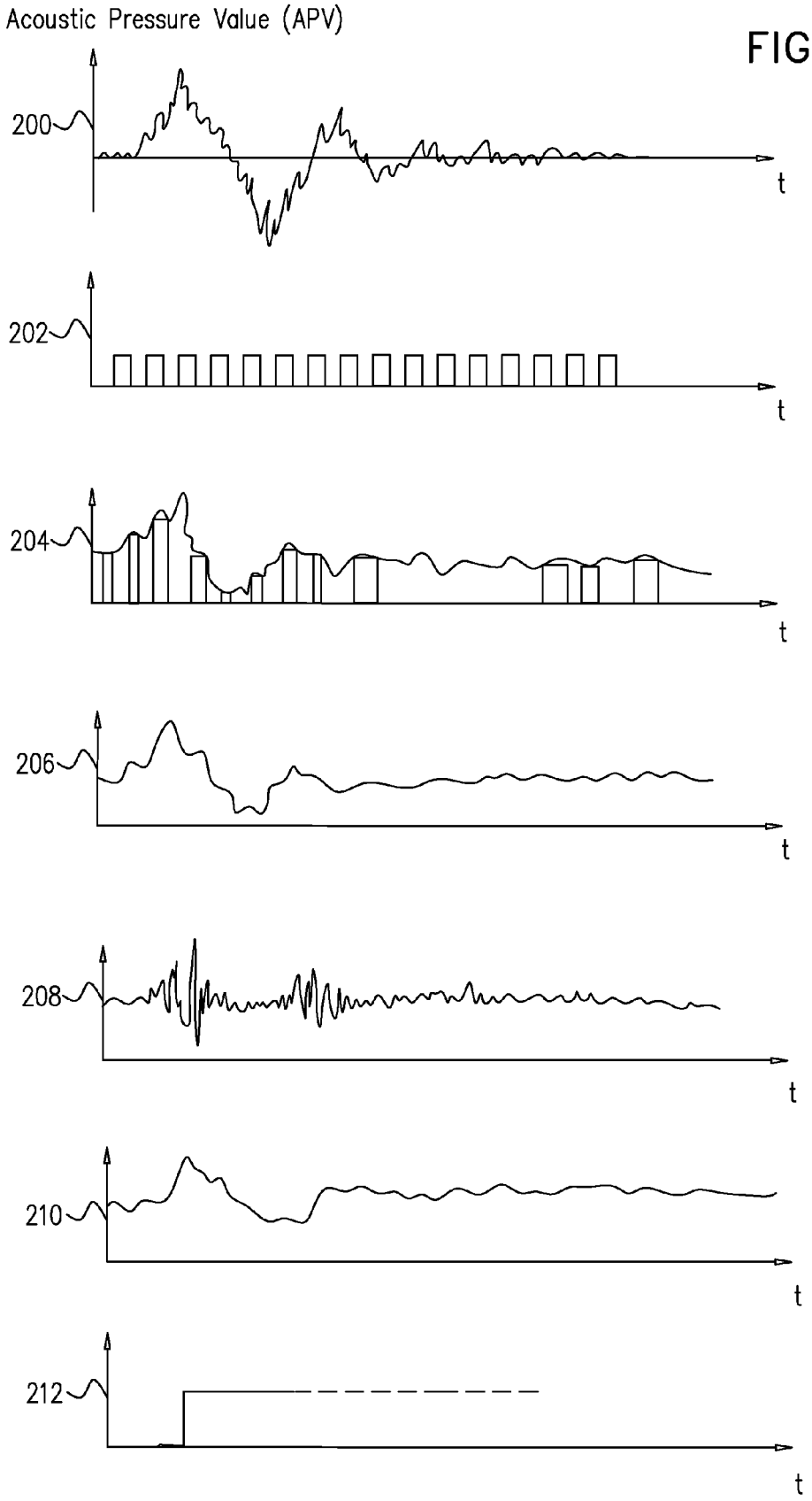
FIG. 2 is a simplified illustration of signals processed by the system of FIG. 1.

Reference is now made to FIG. 1, which is a simplified block diagram illustration of a glass breakage detection system constructed and operative in accordance with a preferred embodiment of the present invention, and to FIG. 2, which is a simplified illustration of signals processed by the system of FIG. 1.

As shown in FIG. 1, the glass breakage detection system 100 preferably includes a microprocessor 102 and a microphone 104 which is operative for detecting acoustic waves such as acoustic signal 200 (FIG. 2).

Microprocessor 102 preferably constantly generates short voltage pulses 202 (FIG. 2), which are then provided to microphone 104 via a load resistor 106. Low power consumption of microphone 104 is achieved by selecting suitable durations of voltage pulses 202 and suitable time intervals therebetween. Responsive to detecting acoustic waves, such as acoustic signal 200, microphone 104 preferably generates output pulsed signals 204 which are then stored by S&H circuitry 108 as voltage level signals 206. Control signals 109 for controlling S&H circuitry 108 are preferably generated by microprocessor 102, and are preferably synchronized with voltage pulses 202.

Voltage level signal 206, which corresponds to acoustic signal 200 is preferably filtered and amplified by a sound frequency band pass amplifier 110 and a flex wave band pass amplifier 112. It is appreciated that sound frequency band pass amplifier 110 is operative to amplify the explosion-like sound typically included in an initial glass breakage sound and that flex wave band pass amplifier 112 is operative to amplify the flex wave typically included in an initial glass-breakage sound.

Filtered and amplified signals 208 and 210 respectively generated by band pass amplifier 110 and flex wave band pass amplifier 112 are then preferably processed by AND circuitry 114, thereby generating a logical signal 212 corresponding to the coexistence of signals 208 and 210, which coexistence of signals is indicative of the occurrence of a typical initial glass-breakage event, as described hereinabove.

Responsive to receiving logical signal 212 indicating the occurrence of a typical initial glass-breakage event, microprocessor 102 is (preferably activated to process signals 208 and 210 and additional signals received subsequent thereto, and to ascertain whether these signals indeed indicate a glass-breakage event.

It will be appreciated by persons skilled in the art that the present invention is not limited by what has been particularly shown and described hereinabove. Rather the scope of the present invention includes both combinations and sub-combinations of the various features described hereinabove as well as modifications thereof which would occur to persons skilled in the art upon reading the foregoing description and Inch are not the prior art.

The invention claimed is:

1. An acoustic glass breakage detector comprising:

a microphone, said microphone being powered by a pulsating microphone current, said microphone being operable for generating pulsed signal data corresponding to sound waves detected thereby and to a pulse of said pulsating microphone current;

a sample and hold circuit operable for:

receiving said pulsed signal data from said microphone;

converting said pulsed signal data into a voltage level signal; and storing said voltage level signal;

a sound frequency band pass amplifier operable for receiving said voltage level signal from said sample and hold circuit and for ascertaining whether said voltage level signal corresponds to an explosion-like sound typical of an initial glass-breakage sound;

a flex wave band pass amplifier operable for receiving said voltage level signal from said sample and hold circuit and for ascertaining whether said voltage level signal corresponds to a flex wave typical of an initial glass-breakage sound; and AND circuitry operable, responsive to both said ascertaining that said voltage level signal corresponds to an explosion-like sound typical of an initial glass-breakage sound and said ascertaining that said voltage level signal corresponds to a flex wave typical of an initial glass-breakage sound, for ascertaining that said pulsed signal data received from said microphone is indicative of a glass-breakage event.

2. An acoustic glass breakage detector according to claim 1 and wherein said sample and hold circuit is powered by a pulsating sample and hold circuit current.

3. An acoustic glass breakage detector according to claim 2 and wherein said detector also comprises a microprocessor operable for synchronously controlling said pulsating microphone current and said pulsating sample and hold circuit current.

4. An acoustic glass breakage detector according to claim 3 and wherein said AND circuitry is also operable, responsive to ascertaining that said pulsed signal data received from said microphone is indicative of a glass-breakage event, to communicate an indication of said glass-breakage event to said microprocessor.

5. An acoustic glass breakage detector according to claim 4 and wherein said microprocessor is also operable, responsive to receiving said indication of said glass-breakage event, for:

receiving and analyzing additional signal data from said sample and hold circuit, said additional signal data being generated subsequent to generation of said signal data indicative of said glass-breakage event; and further ascertaining whether said additional signal data is further indicative of said glass-breakage event.

6. An acoustic glass breakage detector according to claim 1 and wherein said microphone is a wide-band buffered electronic microphone.

7. An acoustic glass breakage detector according to claim 1 and wherein said microphone is operable for detecting sound waves having a frequency between 10 Hz and 16 KHz.

8. An acoustic glass breakage detector according to claim 3 and wherein said microprocessor is operable for synchronously controlling said pulsating microphone current and said pulsating sample and hold circuit current by employing at least one of constant frequency control, variable frequency control and variable duty cycle control.

9. An acoustic glass breakage detector according to claim 1 and wherein said microphone has an average electric current consumption of 3-5 micro amperes.

10. An acoustic glass breakage detector according to claim 1 and wherein said system is battery-powered.

11. A method for acoustically detecting glass breakage, said method comprising:

powering a microphone by a pulsating microphone current;

receiving, by a sample and hold circuit, from said microphone, pulsed signal data generated by said microphone and corresponding to sound waves detected by said microphone;

converting, by said sample and hold circuit, said pulsed signal data into a voltage level signal;

storing, by said sample and hold circuit, said voltage level signal;

receiving, by a sound frequency band pass amplifier, said voltage level signal from said sample and hold circuit and ascertaining, by said sound frequency band pass amplifier, whether said voltage level signal corresponds to an explosion-like sound typical of an initial glass-breakage sound;

receiving, by a flex wave band pass amplifier, said voltage level signal from said sample and hold circuit and ascertaining, by said flex wave band pass amplifier, whether said voltage level signal corresponds to a flex wave typical of an initial glass-breakage sound; and responsive to both said ascertaining that said voltage level signal corresponds to an explosion-like sound typical of an initial glass-breakage sound and said ascertaining that said voltage level signal corresponds to a flex wave typical of an initial glass-breakage sound, ascertaining, by AND circuitry, that said pulsed signal data received from said microphone is indicative of a glass-breakage event.

12. A method for acoustically detecting glass breakage according to claim 11 and also comprising, responsive to ascertaining, by said AND circuitry, that said pulsed signal data received from said microphone is indicative of a glass-breakage event;

communicating, by said AND circuitry, an indication of said glass-breakage event to a microprocessor:

receiving and analyzing, by said microprocessor, additional signal data from said sample and hold circuit, said additional signal data being generated subsequent to generation of said signal data indicative of said glass-breakage event; and further ascertaining, by said microprocessor, whether said additional signal data is further indicative of said glass-breakage event.

13. A method for acoustically detecting glass breakage according to claim 11 and wherein said microphone is a wide-band buffered electronic microphone.

14. A method for acoustically detecting glass breakage according to claim 11 and wherein said microphone is operable for detecting sound waves having a frequency between 10 Hz and 16 KHz.

15. A method for acoustically detecting glass breakage according to claim 11 and wherein said pulsating microphone current is generated by employing at least one of constant frequency control, variable frequency control and variable duty cycle control.

16. A method for acoustically detecting glass breakage according to claim 11 and wherein said microphone has an average electric current consumption of 3-5 micro amperes.

17. A method for acoustically detecting glass breakage according to claim 11 and wherein said microphone is battery-powered.

* * * * *